United States Patent [19]

Duffy et al.

[11] Patent Number: 4,814,197

[45] Date of Patent: Mar. 21, 1989

[54] CONTROL OF ELECTROLESS PLATING BATHS

[75] Inventors: John Duffy, Carlsbad, Calif.; Milan Paunovic, Port Washington, N.Y.; Stephen M. Christian, Commack, N.Y.; John F. McCormack, Roslyn Heights, N.Y.

[73] Assignee: Kollmorgen Corporation, Simsbury, Conn.

[21] Appl. No.: 926,362

[22] Filed: Oct. 31, 1986

[51] Int. Cl.[4] ..... B05D 1/18

[52] U.S. Cl. ..... 427/8; 427/443.1; 427/437

[58] Field of Search ..... 427/8, 443.1, 437

[56] References Cited

U.S. PATENT DOCUMENTS

| | | | |
|---|---|---|---|
| 3,532,519 | 10/1970 | Hirohata | 427/8 |
| 4,132,605 | 1/1979 | Tench | 204/434 |
| 4,209,331 | 6/1980 | Kukanskis | 427/443.1 |
| 4,331,699 | 5/1982 | Suzuki | 427/8 |
| 4,353,933 | 10/1982 | Araki | 427/8 |
| 4,541,902 | 9/1985 | Kinoshita | 204/405 |
| 4,563,217 | 1/1986 | Kikuchi | 427/443.1 |
| 4,565,575 | 1/1986 | Cardin | 427/443.1 |
| 4,623,554 | 11/1986 | Kaschak | 427/8 |
| 4,631,116 | 12/1986 | Ludwig | 204/1 T |

OTHER PUBLICATIONS

R. Haak et al., "Cyclic Voltammetric Analysis of Acid Copper Sulfate Plating Baths" Plating and Surface Finishing, Apr., 1981, pp. 52–55 and Mar., 1982, pp. 62–66.

Milan Pannovic, "An Electrochemical Control System for Electroless Copper Bath" J. Electrochem. Soc., vol. 127, No. 2, Feb. 1980, pp. 365–369.

"Mechanisms of Electroless Metal Plating: II. Decomposition of Formaldehyde", IBM J. Res. Develop. 28, 679 (1984), Bindra et al., IBM J. Res. Develop., vol. 28, No. 6, Nov. 1984, pp. 679–688.

Okinaka, Turner, Wolwodiuk and Graham, Abstract No. 275, Electrochem. Soc. Fall Meeting, Oct. 1976, Extended Abstracts, vol. 76–2.

Okinaka, Graham, Wolwodiuk and Putvinski, The Western Electric Engineer, 22 (2), 72 (1978).

G. Herrmann, Metalloberflache–Agnew. Elektrochem., 26, 334 (1972).

F. L. Shippey, C. U. Yu, and F. M. Donahue, Plating, 762–764 (8) (1972).

M. J. Brown, Insulation/Circuits, 21 (11), 17 (1975).

*Primary Examiner*—Shrive Beck
*Assistant Examiner*—Vi Duong Dang
*Attorney, Agent, or Firm*—Morgan & Finnegan

[57] ABSTRACT

Methods of analyzing and controlling an electroless plating solution are described which provide for real time control of the electroless plating solution, e.g., an electroless copper bath whose main constituents are copper sulfate, complexing agent, formaldehyde, a hydroxide and a stabilizer. All necessary constituent concentrations, particularly the reducing agent concentration, are measured in situ and may be used to analyze and/or control the composition of the bath. A control cycle of less than one minute is required and hence real time control is achieved. The in situ measurements also provide quality indicia of the copper quality factors which are likewise used to control composition of the bath. Data from the in situ measurements is fed to a computer which, in turn, controls additions to the bath to maintain a bath composition which provides good quality electrolessly formed, copper plating.

22 Claims, 7 Drawing Sheets

CONTROL OF ELECTROLESS PLATING BATHS

This invention relates to control of plating solutions. Although electroless copper plating is primarily referred to in the specification, the invention is also applicable to other types of plating.

BACKGROUND OF THE INVENTION

In the printed circuit industry, copper is generally used as an interconnection medium on a substrate. In certain applications, the deposit is practially or completely formed by electroless copper deposition. When an electroless copper plating process is utilized, substantially uniform deposition is achieved regardless of the size and shape of the surface area involved. Very small holes (e.g., 0.15–0.25 mm) are difficult to electroplate because of the electric field distribution in the hole, but such holes are easily plated using an electroless plating process which does not depend on an applied electric field and its distribution. Fine line conductors which are placed near large surface conductor areas (e.g., heat sinks) are difficult to electroplate because of the electric field distortion caused by large conductive areas. Such fine line conductors next to large conductive areas can, however, be effectively plated with an electroless process.

Although there are many benefits to using an electroless plating process, crack formations in the plated copper can occur if the bath constituents are not maintained within precise limits. Typically, these cracks have been found in the electrolessly formed hole wall lining and at the junction with surface conductors. Such cracks on the circuit hole walls are usually not a serious functional problem because the circuit holes are later filled with solder at the time of component insertion. However, cracks can also occur in the fine line conductor traces. With increased component and circuit packaging density, conductor traces of 0.15 mm width are not uncommon and often can best be achieved with an electroless process. Since defects or cracks in the signal traces may not show up until subsequent manufacturing steps or while in use, and since the defects or cracks cannot easily be repaired, it is imperative to produce good quality, crack free copper to assure proper connectivity-and functioning of the circuit signal conductors in such high density circuit boards.

Originally, electroless plating baths were controlled by manual methods. A plating bath operator would take a sample of the solution out of the bath, do various tests on the sample to determine the state of the bath, and then manually adjust the bath by adding the chemical components necessary to bring the bath constituents back to a given bath formulation thought to be optimum. This process is time consuming and, because of manual intervention, not always accurate. Furthermore, becaus of the time lag between analysis and adjustment, the bath adjustments were often incorrect, either over-adjusting or under-adjusting the bath composition and often were not in time to maintain stable operation.

Many methods have been proposed in attempts to partially or totally automate the control of the electroless copper plating bath. Generally, the measurement step in these methods required that a sample be removed from the bath and put into a predetermined state. For example, the sample may have to be cooled or a reagent may have to be added before the actual measurement is taken. The adjustment made to the bath is determined from the prepared sample and measurement taken therefrom. Preparation of a sample can require as much as thirty minutes and, therefore, the adjustment based thereon is not proper for the bath's current state since the bath may have significantly changed state in the time between sample removal and bath adjustment.

Removal of a sample from the bath in order to measure various constituents is undesirable for an additional reason. When a sample is removed from the bath, the environment of the solution changes. Measurements taken off the sample, therefore, do not accurately reflect the plating solution in its natural plating environment.

In an electroless copper plating bath, an important component that must be controlled is the concentration of the reducing agent (e.g., formaldehyde). If the concentration of the reducing agent is too high, the bath decomposes causing uncontrolled plating and eventual destruction of the bath. If the concentration of the reducing agent is too low, the reaction is too slow and deposition of electrolessly formed copper stops or is inadequate. Also, plating often cannot be initiated on the catalyzed surfaces if the reducing agent concentration is too low.

One method of controlling formaldehyde used as a reducing agent is an electroless copper plating bath is illustrated by Slominski, U.S. Pat. No. 4,096,301, Oka et al, U.S. Pat. No. 4,276,323, and Oka, U.S. Pat. No. 4,310,563. This method requires that a sample be withdrawn from the tank, transported to another container, cooled down to a specific temperature and mixed with a sulfite solution in order to perform the actual measurement. The measurement steps and the cleaning of the receptacle to avoid contamination in the next cycle can take up to thirty minutes. By the time the bath adjustment is initiated, the bath may have substantially changed state and, therefore, is not correctly adjusted.

Tucker disclosed a method of control of electroless copper plating solutions in "Instrumentation and Control of Electroless Copper Plating Solutions"; *Design and Finishing of Printed Wiring and Hybrid Circuits Symposium,* American Electroplaters Society, 1976. In the process described, a sample is withdrawn from the bath and cooled down to a predetermined temperature. At the cooled down temperature, the cyanide concentration is measured using an ion specific electrode, the pH is measured, and then the formaldehyde concentration is measured by a titration of a sodium sulfite solution with a sample from the bath. The bath constituents are replenished according to the measurements. This process requires the time consuming steps of withdrawing a sample from the bath, cooling it down and mixing it with a reagent.

Polarography is another method that has been employed for measurement of electroless plating bath parameters. See Okinaka, Turner, Volowodiuk, and Graham, the *Electrochemical Society Extended Abstracts,* Volume 76-2, 1976, Abstract No. 275. This process requires a sample to be removed from the bath and diluted with a supporting electrolyte. A potential is applied to a dropping mercury electrode suspended in the sample, and the current is measured. From the current-potential curve, the concentration of formaldehyde is derived. This process, too, causes a significant time delay between sampling and adjustment.

Araki, U.S. Pat. No. 4,350,717, uses a colorimetric method for measurement. In the colorimetric method, a sample of the bath is drawn, diluted with reagent, heated to develop the color, and then measured with a colorimetric device to determine the concentrations. The heating step alone takes ten minutes. Together the sampling, mixing, heating and measuring steps cause a significant delay between measurement and adjustments in the bath.

Some in situ measurements in an electroless plating bath have been previously disclosed. In the article, "Determination of Electroless Copper Deposition Rate from Polarization Data in the Vicinity of the Mixed Potential", *Journal of the Electrochemical Society,* Vol 126, No. 12, December, 1979, Paunovic and Vitkavage describe in situ measurement of the plating rate of a bath. Suzuki, et al, U.S. Pat. No. 4,331,699, also describe a method for in situ measurement of the plating rate. A chrono potentiometric method for determining formaldehyde and copper is referred to in the *Journal of the Electrochemical Society,* Vol. 127, No. 2, February, 1980. However, these disclosures refer to measurement of specific variables and do not discuss real time methods for overall control of a plating bath, particularly when the electrolessly plated copper forms the conductive pattern of an interconnection board.

In the past, the typical procedure for checking the quality of copper plated in the bath was to place a test board in a plating bath and visually examine for the quality of he copper deposit. Unfortunately, the test board examined might not reflect the true copper quality of the actual work. Mistakes were made in visually examining the samples and often the visual inspections proved to be adequate. The copper quality could change after the test board was plated. A change in loading, i.e., the amount of surface area to be plated, could affect the quality. Frequently, the quality of the bath and, thus, the quality of the copper being plated at the time, would go bad while the actual boards were being plated. As a result, copper quality of the test board as such was not an effective process control parameter.

An object of this invention is to provide a controller for an electroless plating bath that provides for substantially real time control.

Another object of this invention is to provide a controller for an electroless copper plating bath which provides for in situ monitoring, digital measurement, and real-time control.

Still another object of the invention is to provide a contrller that can continuously determine the quality of deposited metal of the plating bath to consistently produce good quality, crack-free plating.

A still further object of this invention is to provide an in situ measurement and control of the stabilizer concentration in the bath.

Yet another object of the invention is to provide in situ measurement and control of the reducing agent concentration in the bath.

Another object of the invention is to provide a process and apparatus for in situ measurement of reducing agent concentration and other parameters that automatically regenerates the electrodes after the measurement.

Still another object is to provide an electrode which can be regenerated in situ to provide a reproducible surface on the electrode for use in making repetitive measurements in an electroless plating bath.

SUMMARY OF THE INVENTION

The invention provides for a real time control of an electroless plating bath, in particular, an electroless copper plating bath wherein the main constituents are copper sulfate, complexing agent, formaldehyde, a hydroxide and a stabilizer. With the invention, all of the necessary constituent concentrations, and particularly the reducing agent (e.g., formaldehyde) concentration, are measured in situ and used to control the composition of the bath. A control cycle of less than one minute is required and, hence, real time control is achieved. The in situ measurements also provide quality indicia of the copper quality factors which are likewise used to control composition of the bath. Data from the in situ measurements is fed to a computer which, in turn, controls additions to the bath to maintain a bath composition which provides good quality, electrolessly formed, copper plating.

In accordance with the invention it has been discovered that the reducing agent (e.g., formaldehyde) concentration can be measured in situ in a matter of seconds by sweeping a potential across a pair of electrodes covering a predetermined range. The potential sweep drives the oxidation reaction of reducing agent on the surface of the electrode. The oxidation current rises with the potential to peak current. The peak current measured over the range is a function of the reducing agent concentration. The potential that corresponds to the peak current also provides an indication of the stabilizer concentration.

In accordance with the invention, it also has been discovered that application of a sweep potential across the electrodes covering a range going from cathodic to anodic produces data indicating the copper quality. If the intrinsic anodic reaction rate exceeds the intrinsic cathodic reaction rate, i.e., the ratio exceeds 1.0, copper plating quality is bordering on unacceptable. A ratio of 1.1 or greater for any significant length of time indicates unacceptable quality.

In addition to measuring reducing agent concentration and intrinsic reaction rates, the sweep potential also can be used to measure copper concentration and other parameters. Other sensors also can be used to measure copper concentration, pH, temperature and, where useful, specific gravity, cyanide concentration and other specific concentrations. The measured values are compared with set points for the particular bath formulation and additions to the bath are controlled in accordance with the extent of departure from the set points.

For quality copper plating, the quality index (ratio of intrinsic anodic reaction rate to intrinsic cathodic reaction rate) should be about 1.0. If the quality index is only slightly out of the range (i.e., 1.0 to 1.05) according to a preferred method of process control according to the invention, the system adjusts the bath composition by altering certain set points. Normally, decrease in the formaldehyde concentration and/or an increase in the copper concentration improves the intrinsic rate ratio and ensures adequate copper plating quality. If after a number of iterations, the situation has not been corrected with the ratio returned to a value below 1.0, or if the quality index exceeds 1.05, water is added to the bath to overflow the system so that the dilution of reaction by-products and other contaminants, and replenishment of the bath constituents provides an improved bath composition. Alternatively, if the bath includes filtering equipment, the flow through the filter can be increased to purify the solution. If the quality index exceeds 1.1, any work in process should be removed and the bath shut down for treatment or discarded. Momentary excursions above 1.1 can be tolerated and good quality plating resumed if corrective action is taken to reduce the index to acceptable values. Although set point adjustment, water overflow and filtering control are used in combination in the preferred control method, they can be used individually to provide effective control.

The electrodes used with the system according to the invention are periodically regenerated (preferably after each measuring cycle) in order to achieve a virginal reconsructed surface in situ, for real time, continuous measurement control. This is achieved by first applying a large stripping pulse capable of deplating the test electrode to remove all copper and other reaction by-products and then by permitting that electrode to replate in the bath to resurface the electrode with a clean copper coating. The electrode may be replated either at the electroless plating potential or at an applied potential. The regenerated electrode is used as the test electrode in making measurements. This regenerated electrode eliminates problems associated with regeneration outside the bath and problems associated with the dropping mercury electrode regeneration technique.

DETAILED DESCRIPTION OF THE INVENTION

Figure 1:
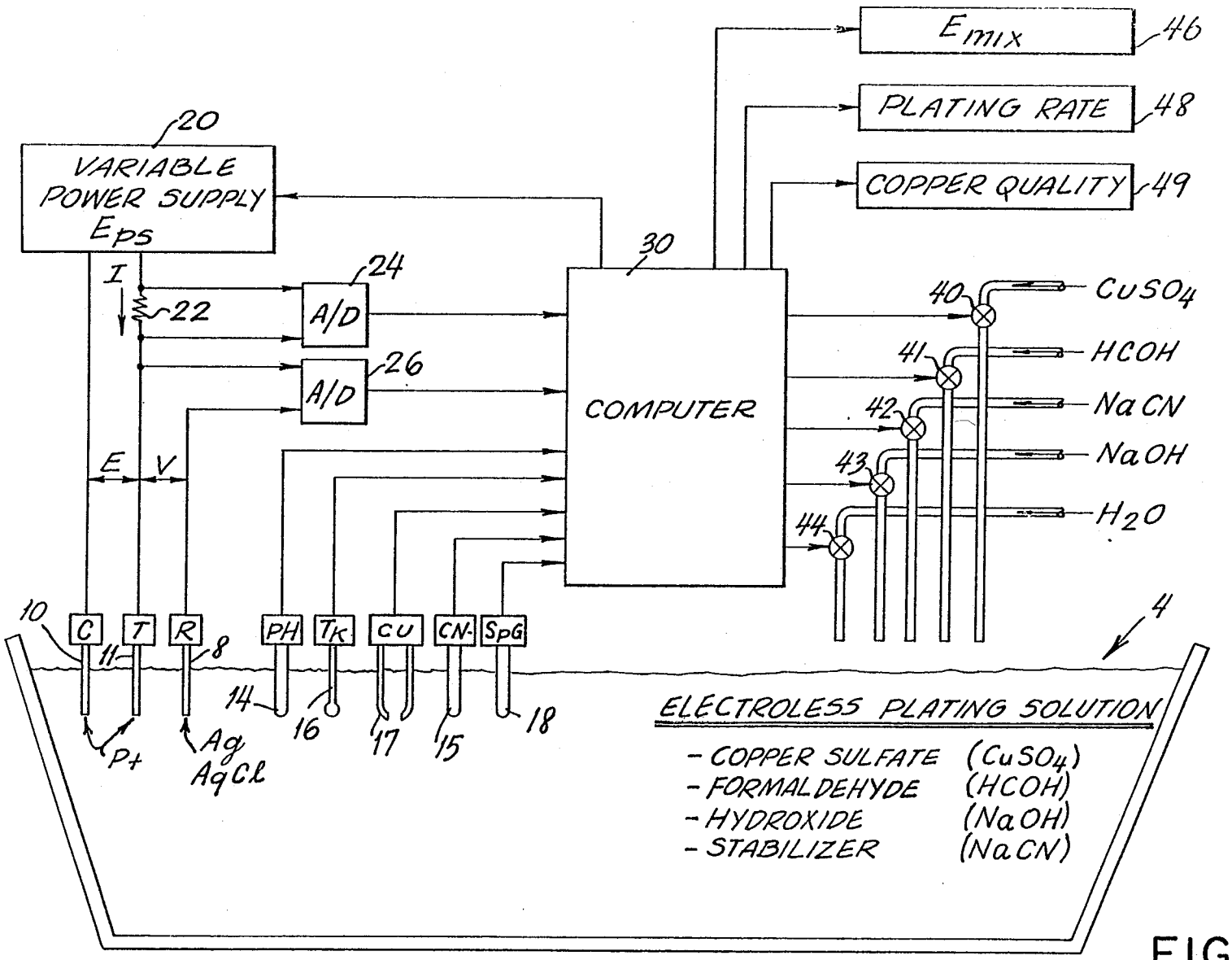
FIG. 1 is a schematic illustration showing the overall process control including the various measurement sensors and the control of chemical additions to the plating bath.

This invention provides for in situ measurement and control of an electroless plating bath. FIG. 1 illustrates the invention used to control an electroless copper plating bath 4 wherein the principal constituents of the solution are copper sulfate, complexing agent, formaldehyde, a hydroxide such as sodium or potassium hydroxide and a stabilizer such as a sodium cyanide.

A suitable electroless copper plating bath for the present invention includes one with a stabilizer system using both vanadium and cyanide addition agents. The formulation is as follows:

| | |
|---|---|
| Copper Sulfate | 0.028 moles/l |
| Ethylenedinitrilotetraacetic Acid (EDTA) | 0.075 moles/l |
| Formaldehyde | 0.050 moles/l |
| pH (at 25° C.) | 11.55 |
| $[HCHO][OH^-]^{0.5}$ | 0.0030 |
| Surfactant (Nonylphenylpolyethoxyphosphate Gafac RE 610 TM from GAF Corp.) | 0.04 grams/l |
| Vanadium Pentoxide | 0.0015 grams/l |
| Sodium Cyanide (by specific electrode No. 94-06 TM from Orion Research, Inc. Cambridge, MA 02138) | −105 mV vs. SCE |
| Specific Gravity (at 25° C.) | 1.090 |
| Operating Temperature | 75° C. |

For additional details concerning other suitable bath formulations, see copending application, "Method for Consistently Producing a Copper Deposit on a Substrate by Electroless Deposition Which Deposit Is Essentially Free of Fissures", by Rowan Hughes, Milan Paunovic and Rudolph J. Zeblisky filed concurrently herewith, the disclosure of which is incorporated by reference.

An electroless metal plating bath or solution includes a source of metal ions and a reducing agent for the metal ions. The reducing agent oxidizes on a catalytic surface and provides electrons on the surface. These electrons, in turn, reduce the metal ions to form a metal plating on the surface. Thus, in electroless plating there are two half reactions, one in which the reducing agent is oxidized to produce the electrons and the other in which the electrons reduce the metal ions to plate out the metal.

In an electroless copper plating solution, such as indicated in FIG. 1, one of the half reactions is the reaction of a formaldehyde reducing agent (HCOH) in an alkaline solution (NaOH) to produce electrons on sites catalytic to the oxidation reaction. This reaction is referred to as an anodic reaction and takes place on catalytic conductive surfaces such as copper and certain other metals. The other half reaction, reducing the copper ions to plate out copper metal, is referred to as a cathodic reaction At steady state, the anodic reaction rate is equal and opposite to the cathodic reaction rate. The potential at which both the anodic and the cathodic half reactions proceed without any external potential being applied is the "mixed potential" of the plating solution, referred to herein as $E_{mix}$. When an external potential is supplied, e.g., from a power supply to the surface of an electrode, the steady state is disturbed. If the electrode surface potential is positive relative to $E_{mix}$, then the anodic reaction rate increases whereas, if the electrode surface potential is negative, the cathodic reaction rate increases. The intrinsic anodic reaction rate, Ra, is measured on the surface of an electrode where the potential is slightly more positive than the mix potential of the solution. Similarly, the intrinsic cathodic reaction rate, Rc, is measured on an electrode surface slightly more negative than the mix potential.

In the FIG. 1 embodiment a sensor is placed in the bath A counter electrode 10, a test electrode 11 and a reference electrode 8 are utilized to measure the formaldehyde concentration, copper concentration, stabilizer concentration, plating rate, and the quality of plated copper. A pH sensing electrode 14 is used to measure pH, a cyanide sensing electrode 15 is used to measure cyanide concentration, and the temperature of the bath is measured using a temperature sensing probe 16. The copper concentration also can be measured in situ utilizing a fiber optic spectrophotometric sensor 17. Specific gravity of the bath solutions is measure by a probe 18.

Preferably, these sensors are configured within a common bracket which is placed in the bath. The bracket allows for easy insertion and removal of the sensors and probes.

The potential $E_{mix}$ is measured using a calomel or a silver/silver chloride electrode as reference electrode 8 in combination with a platinum test electrode 11 with an electroless copper coating developed in the bath. The electrodes develop the mix potential of the solution in about 5 seconds. An analog to digital (A/D) converter 26 is connected to electrodes 8 and 11 to sense the potential $E_{mix}$ and to provide a corresponding digital indication thereof.

The intrinsic reaction rates and thus quality of copper, plating rate, formaldehyde concentration, copper concentration stabilizer, concentration, or some selected group of these parameters, are measured using electrodes 8, 10 and 11. Electrodes 10 and 11 are platinum and, as previously mentioned, electrode 8 is a reference electrode such as a sliver/silver chloride electrode. A variable power supply 20 is connected to apply a potential difference E between electrodes 10 and 11. A resistor 22 is connected in series with electrode 11 and is used to measure current I through the circuit. When the electrodes are placed in the bath, the plating bath solution completes the electrical circuit and the current flow I for the circuit passes through resistor 22.

Power supply 20 is controlled to apply a potential sweep to the electrodes which drives the reaction on the surface of test electrode 11 anodic so as to measure the reducing agent concentration by driving the potential through the region of oxidation for that reducing agent. For accuracy the potential sweep should begin at mix potential.

Figure 2A:
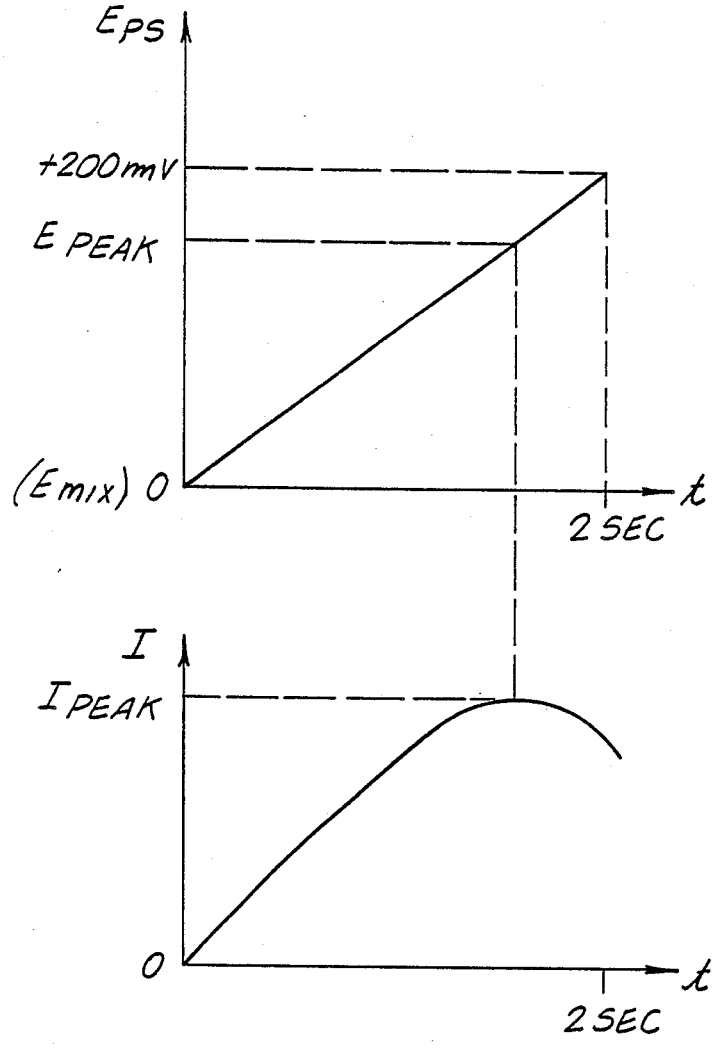
FIG. 2A is a set of voltage and current curves during a potential sweep from zero to 200 mV.

At the start of the measurement sequence (after an initial equilibration period), the test electrode is driven anodic by the power supply, i.e., the applied potential difference is positive at test electrode 11 and negative at counter electrode 10. The current I passing through resistor 22 is measured by measuring the potential drop across the resistor and converting to a digital value by means of an analog to a digital (A/D) converter 24. The test electrode is driven increasingly more anodic until a peak in the current response is reached. For formaldehyde, the sweep potential as measured by A/D converter 26 is increased at a 100 mV/sec rate for about two seconds, as shown in FIG. 2A. The current and potential data from converters 24 and 26 are recorded during application of the sweep potential. As shown in FIG. 2A, the current reaches a peak value, $I_{peak}$, which is a function of formaldehyde concentration.

The formaldehyde concentration is calculated utilizing the following equation:

$$[HCHO]=I_{peak}K_1/(T_k[OH]^{\frac{1}{2}})$$

where $I_{peak}$ is the peak current, $T_k$ is the temperature of the bath in degrees Kelvin, $[OH]^{\frac{1}{2}}$ is the square root of the hydroxide concentration value and $K_1$ is a calibration constant The temperature $T_k$ is provided by sensor 16 and the hydroxide concentration is derived from the measurement provided by pH sensor 14. The calibration constant is empirically determined based on comparison with known values of formaldehyde concentration.

Figure 2B:
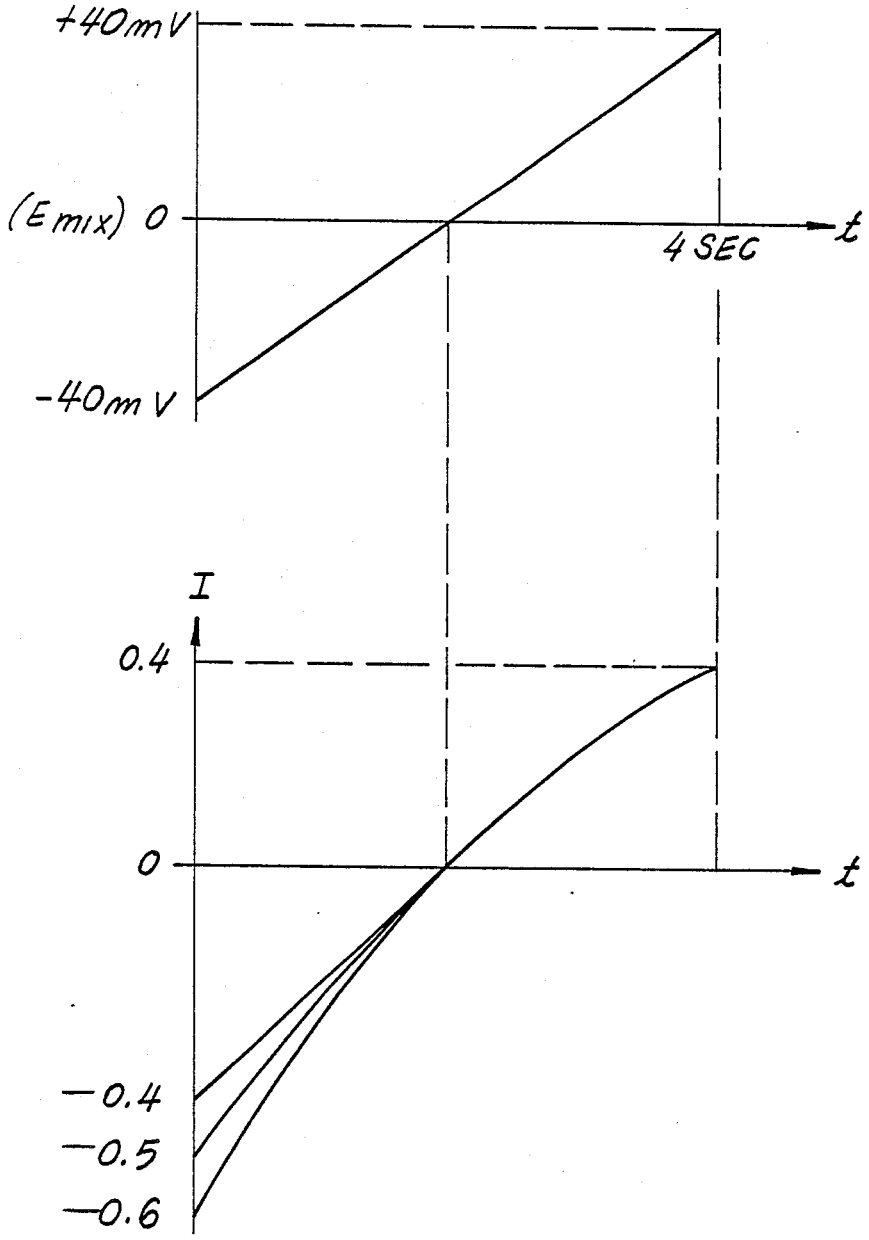
FIG. 2B is a set of voltage and current curves during a potential sweep from −40 mV to +40 mV.

The circuit including test electrode 11 and counter electrode 10, resister 22, and power supply 20, is used to measure the plating rate of the bath as well as the intrinsic reaction rates. A potential is applied to electrodes 10 and 11 to initially lower the potential of test electrode 11 (relative to reference electrode 8) so that the potential V is negative 40 mV as measured by converter 26. The potential then is changed in the positive direction to provide a potential sweep at the rate of 10 mV/sec for 8 seconds. Thus, as shown in FIG. 2B, the potential sweeps from −40 mV to +40 mV. During this period, the potential drop across the resistor is measured representing the current I. The values of V and I are recorded during the sweep. The copper plating rate can be calculated from this data using the equations explained by Paunovic and Vitkavage in their article, "Determination of Electroless Copper Deposition Rate from Polarization Data in the Vicinity of the Mixed Potential", *Journal of the Electrochemical Society,* Vol 126, No. 12, December, 1979, incorporated herein by reference.

The range −40 mV to +40 mV is preferred, but other ranges can be used. Generally, larger ranges provide a larger error indication caused by deviations from linearity whereas smaller ranges permit more accurate determination of the zero cross over point at $E_{mix}$.

To determine the plating rate and intrinsic reaction rates, the incremental values for $E_m$, relative to the bath potential $E_{mix}$, are first converted to $E_j$ values according to the equation:

$$E_j=10^{vj/ba}-10^{-vj/bc}$$

wherein $V_j$ is the absolute value of the incremental voltage relative to $E_{mix}$ where $b_a$ is the Tafel slope of the anodic reaction and $b_c$ is the Tafel slope of the cathodic reaction. For the bath composition described herein the value of $b_a=840$ and the value of $b_c=310$. The deposition rate can then be calculated using the equation:

$$\text{Dep Rate} = \sum_{j=1}^{n} [I_jE_j]/\sum_{j=1}^{n} [(E_j)^2].$$

The copper plating quality index is determined by comparing the intrinsic reaction rates for the anodic potential values (positive potential region in FIG. 2B) and the cathodic potential values (negative potential region in FIG. 2B) and, thus, for the anodic and cathodic reactions. If the ratio "Q" of the intrinsic anodic reaction rate to the intrinsic cathodic reaction rate is about 1.0, the quality of the deposited copper will be adequate to pass the thermal shock test according to Mil. Spec. 55110-C. The ratio can be as high as 1.1. and still produce satisfactory quality electroless plating.

In FIG. 2B are illustrated the current responses from the input of the −40 mV to +40 mV potential sweep. For purposes of illustration, responses from three different solutions are shown. All the three solutions are depicted with the same anodic response, but three different cathodic responses. The quality ratio of the three different cathodic responses to the anodic responses as depicted in FIG. 2B are 1.23, 1.02 and 0.85.

As can be seen in FIG. 2B, lower curve, the cathodic and anodic reaction rates may vary and result in poor cooper quality. If the anodic reaction produces too many electrons, copper deposits too rapidly and the copper atoms have insufficient time to find their correct location in the crystal lattice. If the copper quality index, Q, is below 1.0, high quality copper crystals are formed. If Q is in the range 1.0 to 1.05, good crystals are formed but moderate corrective action should be taken to reduce Q; if Q is in the range 1.05 to 1.1, stronger corrective action should be taken; and if Q exceeds 1.1, the work in process should be removed and the plating process should be shut down. Thus, for adequate quality of the deposited copper, Q must be below 1.1., is preferably below 1.05, and is most preferably below 1.0. For illustrative purposes, Q for the electrodes copper plating bath formulation described above has been measured as 0.89.

The copper concentration can conveniently be determined by measuring optical absorption by copper in the solution. This may be accomplished using a pair of fiber optic light conductors 17 placed in the bath to measure copper concentration. The ends of the conductors are placed facing each other with a premeasured space between the ends. A light beam is transmitted through one of the fiber optic conductors, through the plating solution and then through the other conductor. A spectophotometer is used to measure the intensity of the beam emerging from the conductors at the copper absorbing wavelength. As the copper ion concentration in the solution increases, more light is absorbed. The copper concentration of the bath can therefore be established as a function of measured light absorption.

Figure 4:
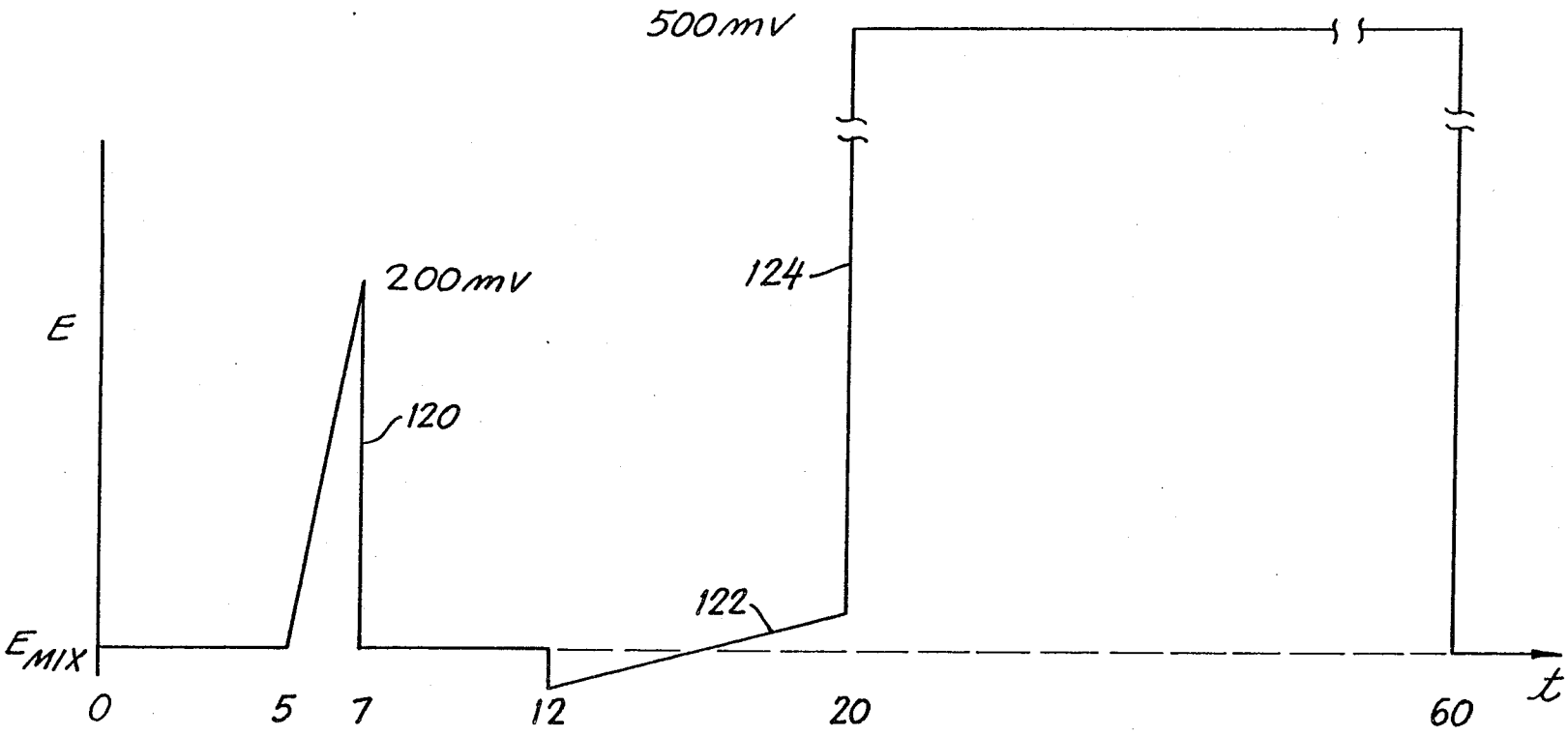
FIG. 4 is a potential profile for a typical mmeasurement cycle.

In an alternative method, copper is analyzed by a cyclic voltammetry method similar to that used to analyze the formaldehyde. A potential sweep moving in the negative direction from $E_{mix}$ is applied to the measuring electrode. The negative peak obtained is proportional to the copper concentration. Referring to FIG. 4, when this electrochemical copper analysis is used, the negative moving potential sweep for copper analysis is used, the negative moving potential sweep for copper analysis takes place after measuring the plating ratio and before regenerating the electrode surface. Preferably, the electrode surface is regenerated before measuring the formaldehyde current and also is regenerated again before measuring the copper peak current.

A measure for the specific gravity of the bath also is desirable since an excessively high specific gravity is an indication that the bath is plating improperly. If the specific gravity is in excess of a desired setpoint, water is added to the plating bath solution to bring the specific gravity back into allowable limits. The specific gravity may be measured by various known techniques, for example, as a function of the light index of refraction. A probe 18 in the form of a triangular compartment with transparent sides may be placed in the bath such that the plating bath solution flows through the center of the compartment. A beam of light, other than red, is refracted by the bath solution. The specific gravity of bath is proportional to the degree of refraction which can be measured by a series of detectors in a linear array located outside the transparent triangular compartment.

If a cyanide stabilizer compound is used, a probe 15 for measuring cyanide concentration in the plating bath can usefully be included. This probe involves reading the potential difference between a selective ion electrode and a reference electrode (Ag/AgCl). This potential increases with temperature so that a correction is needed to compensate for temperature.

The test electrode 11 is periodically regenerated in order to achieve a reproducible reference surface for continuous in situ measurements. After completion of each measurement cycle, the test electrode is preferably regenerated to prepare for the next cycle of measurements. A substantial potential, e.g., +500 mV above the mixed potential is supplied by power supply 20 for at least about 45 seconds, and preferably longer, to strip the electrode of copper and oxidation by-products generated by the previous measurements. In the stripped condition, electrode 11 is restored to a clean platinum surface. Since the electrode is in an electroless plating bath, copper plates onto the electrode surface after the stripping pulse ceases. About 5 seconds are adequate to resurface the electrode with copper in preparation for a new measurement cycle. This capability to regenerate the electrode in situ is important because it eliminates the need for time consuming removal of electrodes from the bath in order to clean or regenerate the surfaces and is thus a prerequisite to real time control of the bath.

FIG. 4 shows a voltage profile for a repetitive measurement cycle. For the first five seconds, no potential is applied to the electrodes. During this period, the electrodes are permitted to electrically float and equilibrate in the solution to assume the mixed potential $E_{mix}$ which is measured and recorded. Next, a positive sweep potential 120 is applied for 2 seconds (from t=5 to t=7) increasing the measured potential V to about 200 mV above $E_{mix}$. This sweep provides data for determining the formaldehyde and stabilizer concentrations. Next, the electrodes again are permitted to electrically float or equilibrate for about 5 seconds (from t=7 to t=12) to again assume the mixed potential $E_{mix}$. Next, a negative potential is applied (at t=12) followed by an 8 second positive sweep 122 (from t=12 to t=20) passing through $E_{mix}$ at about its midpoint. This sweep provides data for determining the intrinsic anodic and cathodic reaction rates, the copper quality index and the copper plating rate. To complete the cycle, a large positive stripping pulse 124 (500 mV above $E_{mix}$ for about 40 seconds) is applied to strip the platinum test electrode of copper and other reaction by-products. During the initial 5 seconds of the next cycle, prior to application of the first potential sweep, the electroless plating solution resurfaces the test electrode with a clean copper coating. The overall cycle is about 1 minute, but could be shorter if desired.

The voltage profile can be tried. For example, the first and second voltage sweeps can be interchanged in time. Also, the potential sweeps may be combined into a single sweep going, for example, from −40 mV to +200 mV. Each cycle, however, should include a large stripping pulse followed by a period which permits resurfacing of the test electrode.

In an alternative procedure using only the first voltage sweep, the intrinsic anodic and cathodic reaction rates are calculated. The second voltage sweep is omitted. Instead of determining concentrations of the reactants in order to replenish the solution, replenishments of the reducing agent, formaldehyde, and/or the metal ion, copper, are made automatically, in order to maintain constant intrinsic reaction rates. When the second voltage cycle is omitted, the regenerated electrode surface can be reused for 10 to 50 sweep cycles before regenerating the electrode again.

Another test voltage profile which can be used in analyzing an electroless copper test solution is a truncated triangular wave which starts at a cathodic voltage of approximately −735 mV vs. the saturated calomel electrode. The voltage is increased at a rate of 25 mV/sec for 2.3 sec until it reaches −160 mV vs. the saturated calomel electrode. The current recorded during this portion of the test voltage profile is used to calculate both the quality index and the formaldehyde concentration. The currents between −30 mV vs. $E_{mix}$ and $E_{mix}$ are used to calculate the intrinsic cathodic reaction rate. The currents from $E_{mix}$ to +30 mV vs. $E_{mix}$ are used to calculate the intrinsic cathodic reaction rate. Formaldehyde concentration is determined from the peak current during the sweep. At −160 mV, copper is dissolved from the electrode. The voltage is held at −160 mV until the copper stripping current drops indicating all the copper has been stripped from the electrode. The voltage is then swept in a negative direction at optionally −25 mv/sec until it reaches −735 mV vs. the saturated calomel electrode. The voltage is held at −735 mV until the current rises indicating the electrode has been resurfaced with a fresh copper layer and is ready for a new cycle.

The potential profile and the magnitudes of the aPplied potential depends on the type of plating solution. For example, an electroless nickel plating solution comprising nickel ions and sodium hypophosphite (Na $H_2PO_2$) would use a similar voltage profile but corresponding to the reaction rates of the hypophosphite. Different constituents, particularly different reducing agents, in the bath require adjustments in the magnitudes of the applied potentials. Among the reducing agents that are suitable for the reduction of copper ions are formaldehyde and formaldehyde compounds such as formaldehyde bisulfite, paraformaldehyde, and trioxane, and boron hydrides such as boranes and borohydrides such as alkali metal borohydrides.

Although a three electrode system including electrodes 8, 10 and 11 is shown in FIG. 1, similar results can be achieved using two electrodes. The reference electrode can be eliminated if the remaining electrode 10 is made sufficiently large that current flow through the electrode does not significantly change the surface potential.

The composition and operation of the plating solution is controlled by digital computer 30. The computer receives information from sensors 8–18. The computer also controls power supply 20 in turn to control the potential supplied to electrodes 10 and 11 so as to provide the required sweep potentials, stripping pulses and equilibration intervals. During a potential sweep, the values of I and V are measured via converters 24 and 26, and the incremental measured values are stored for later analysis.

Computer 30 also controls valves 40–44 which, control additions to the bath. In the example shown in FIG. 1, the valves respectively control the addition of copper sulfate, formaldehyde, sodium cyanide, sodium hydroxide and water to the plating bath. Valves 40–44 are preferably of the open/shut type where the volume of chemical addition is controlled by controlling the duration of the interval during which the valve is open. In a typical operating cycle, the computer obtains information from the various sensors, analyzes the data and then opens the respective valves for predetermined time intervals to thereby provide the correct quantity of chemical addition required in the bath.

The computer also can provide various output indications such as a display 46 of the $E_{mix}$ value, a display 48 indicating the plating rate, and a display 49 indicating the copper quality. An indication of $E_{mix}$ is desirable since departure from the normal range indicates improper operation of the plating bath. An indication of the plating rate is desirable so the operator can determine the proper length of time required to achieve desired plating thickness. The copper quality indication is, of course, important to assure proper operation free from cracks and other defects.

Figure 3A:
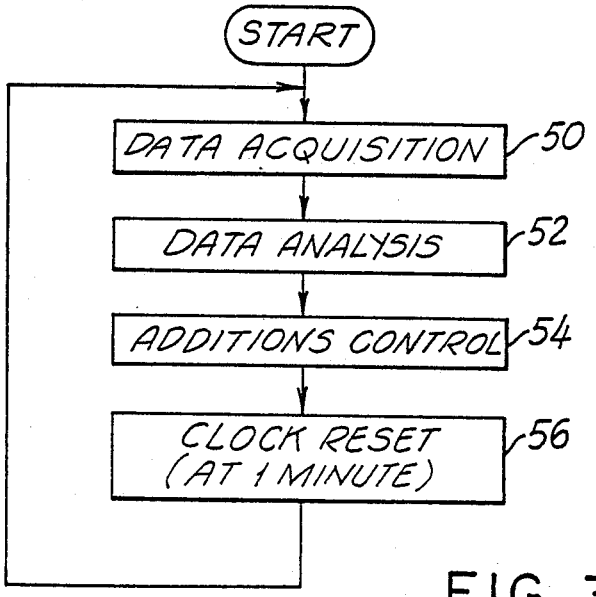
FIG. 3A is a flow diagram for the overall computer program and FIGS. 3B, 3C and 3D are flow diagrams for various program sub-routines.

The program for computer 30 is illustrated in flow diagram form in FIGS. 3A–3D. FIG. 3A illustrates the overall computer program including a data acquisition sub-routine 50 followed by data analysis sub-routine 52 which in turn is followed by an addition control subroutine 54. Preferably, the control system operates in regular cycles of approximately 1 minute as indicated in FIG. 4. During a cycle, data is acquired and analyzed and the results used to control additions to the bath. A clock is used to time the cycle, and a clock rest 56 is used to initiate a new cycle after completion of the 1 minute cycle interval.

Figure 3B:
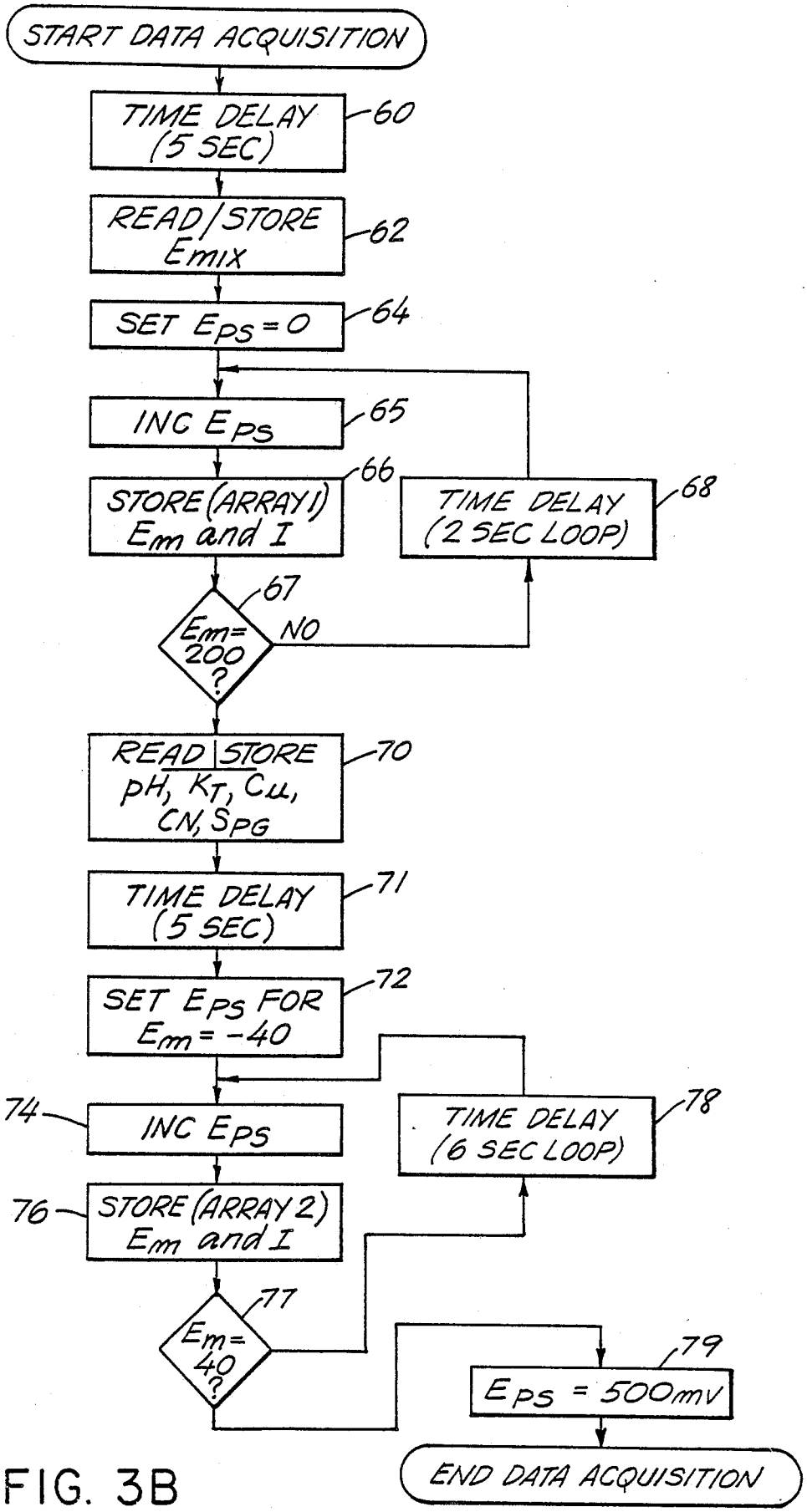

The flow diagram for the data acquisition sub-routine is shown in FIG. 3B. At the start of the sub-routine, a time delay 60 is provided for approximately 5 seconds so that electrodes 8 and 11 can equilibrate to the plating solution potential. After the 5 second delay, the computer reads the potential $E_{mix}$ obtained via A/D converter 26 (FIG. 1) and stores this value in step 62.

The computer next operates in a loop which provides the first voltage sweep (sweep 120 in FIG. 4) for the C and T electrodes 10 and 11. Initially the computer sets power supply 20 at a zero output voltage by setting $E_{ps}=0$ in step 64. The power supply voltage is incremented in step 65. The value of V received from A/D converter 26 and the value of current I through resistor 22 obtained via A/D converter 24 are recorded in the computer memory in step 66. In decision 67, the computer next checks to determine if the value of V has reached 200 and, if not, returns to step 65 after a suitable time delay in step 68. The computer continues in loop 65–68, incrementally increasing the power supply output until such time as decision 67 determines that the value has reached $E_m=200$. The time delay in step 68 is adjusted so that the voltage sweep from zero to 200 mV takes approximately 2 seconds.

After decision 67 has determined that the first sweep potential has reached its maximum value, the program progresses to steP 70 during which the computer reads and stores values from pH probe 14, temperature $T_k$ probe 16, copper concentration probe 17, cyanide concentration probe 15 an specific gravity probe 18. The measured values all are stored at appropriate locations in the computer memory. In step 71 the Program provides a 5 second delay for the electrodes to equilibrate prior to the second voltage sweep.

The program next progresses through another loop which provides the second potential sweep (sweep 122 in FIG. 4) to electrodes 10 and 11 through suitable control of power supply 20. In step 72, the power supply is set so that the initial value of $V=-40$ mV. The first step in the loop is to increment the value of $E_{ps}$ and then to read and store the values of potential V and current I in steps 74 and 76. In decision 77, the Program determines whether the end point value $V=+40$ mV has been reached and, if not, the program returns to step 74 after a time delay provided in step 78. As the program progresses through the loop 74–78, the power supply voltage increases from the initial value of $-40$ mV to the final value $V=+40$ mV. The time delay in step 78 is adjusted so that the voltage sweep from $-40$ mV to $+40$ mV takes approximately 8 seconds. A determination that V is equal to 40 mV in decision 77 indicates completion of the data acquisition procedure. Before ending the subroutine, however, the program sets the power supply to 500 mV to start the stripping pulse (pulse 124 in FIG. 4) which continues during the data analysis and additions control subroutines.

Figure 3C:
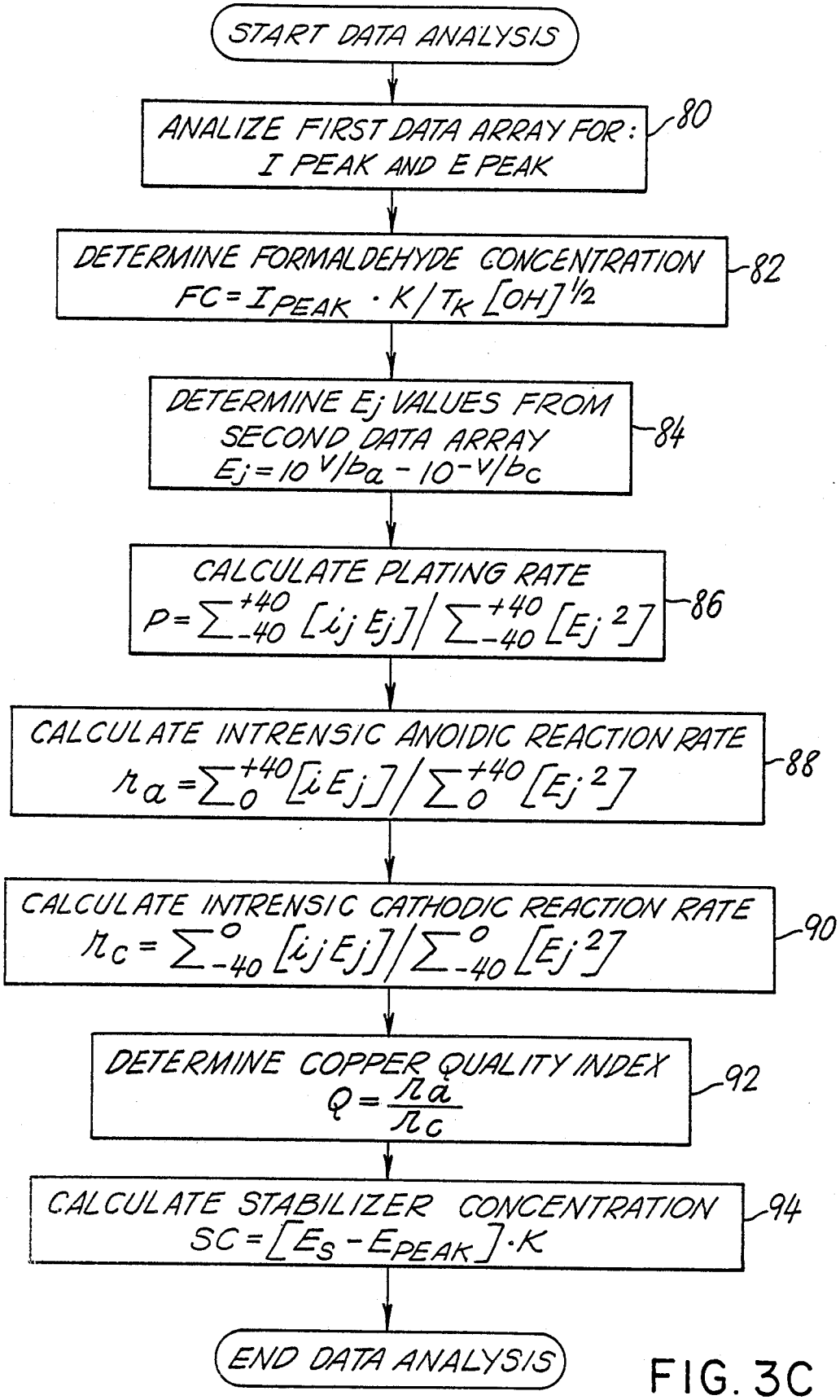

The flow diagram for the data analysis sub-routine is shown in FIG. 3C. In step 80, the computer first analyzes the data in a first data array which is the data acquired during the first potential sweep applied to electrodes 10 and 11 (i.e., steps 65–68). The data is analyzed to determine the highest current value $I_{peak}$ and the corresponding voltage $E_m$. The peak current value can be determined using a simple program whereby the initial value of current is placed in the accumulator and compared with each of the subsequent values. If the subsequent value is greater than the value in the accumulator, then the subsequent value is substituted for the accumulator value. At the completion of the comparisons, the value in the accumulator will be the largest value $I_{peak}$ of current in the data array. The corresponding voltage is $E_{peak}$. In step 82, the computer next determines the formaldehyde concentration using the equation:

$$FC=I_{peak}K/(T_K[OH]^{\frac{1}{2}})$$

$I_{peak}$ is the value determined in step 80, $T_k$ is the temperature value from probe 16 and (OH) is determined in the pH measurement from probe 14. The constant K is determined empirically from laboratory bench work.

In step 84, the data is analyzed from the second data array which was acquired during the second voltage sweep from −40 to +40 (i.e. steps 74–78). The first step is to determine the $E_j$ values according to the equation:

$$E_j=10^{vj/ba}-10^{-vj/vc}$$

wherein $V_j$ is the absolute value of the incremental voltage relative to $E_{mix}$, $b_a$ is the anodic reaction rate and $b_c$ is the cathodic reaction rate.

The plating rate P can be determined in step 86 using the equation $$P=\sum_{-40}^{+40}[I_jE_j]/\sum_{-40}^{+40}[(E_j)^2].$$

For the overall plating rate for the process, the summations cover the entire range from −40 mV to +40 mV.

For determining the copper quality index Q, the intrinsic anodic reaction rate $R_a$ is determined over the range from zero to +40 in step 88 whereas the intrinsic cathodic reaction rate $R_c$ is determined over the range from −40 to zero in step 90. Thus, the equations for $R_a$ and $R_c$ are as follows:

$$R_a=\sum_{0}^{+40}[I_jE_j]/\sum_{0}^{+40}[(E_j)^2].$$

$$R_c=\sum_{-40}^{0}[I_jE_j]/\sum_{-40}^{0}[(E_j)^2].$$

As shown in FIG. 2B, lower curve, the reaction rate in the anodic region remains fairly constant whereas the reaction rate in the cathodic region can vary. The copper quality index Q is calculated in step 92 and is the ratio of $R_a$ to $R_C$. A copper quality index Q greater than 1.0 is undesirable and requires correction. A quality index Q greater than 1.1 normally requires shutdown of the bath.

The computer also can determine the stabilizer concentration by a further analysis of data in the first data array. The stabilizer concentration is a function of the voltage $E_{peak}$. Thus, if compared with a standard reference peak value of $E_s$, the stabilizer concentration SC can be determined in step 94 from the following equation:

$$SC=[E_s-E_{peak}]K$$

Further analysis of the data is possible, but steps 80–94 provide the analysis found most useful in controlling the plating process and in displaying status indicators.

Figure 3D:
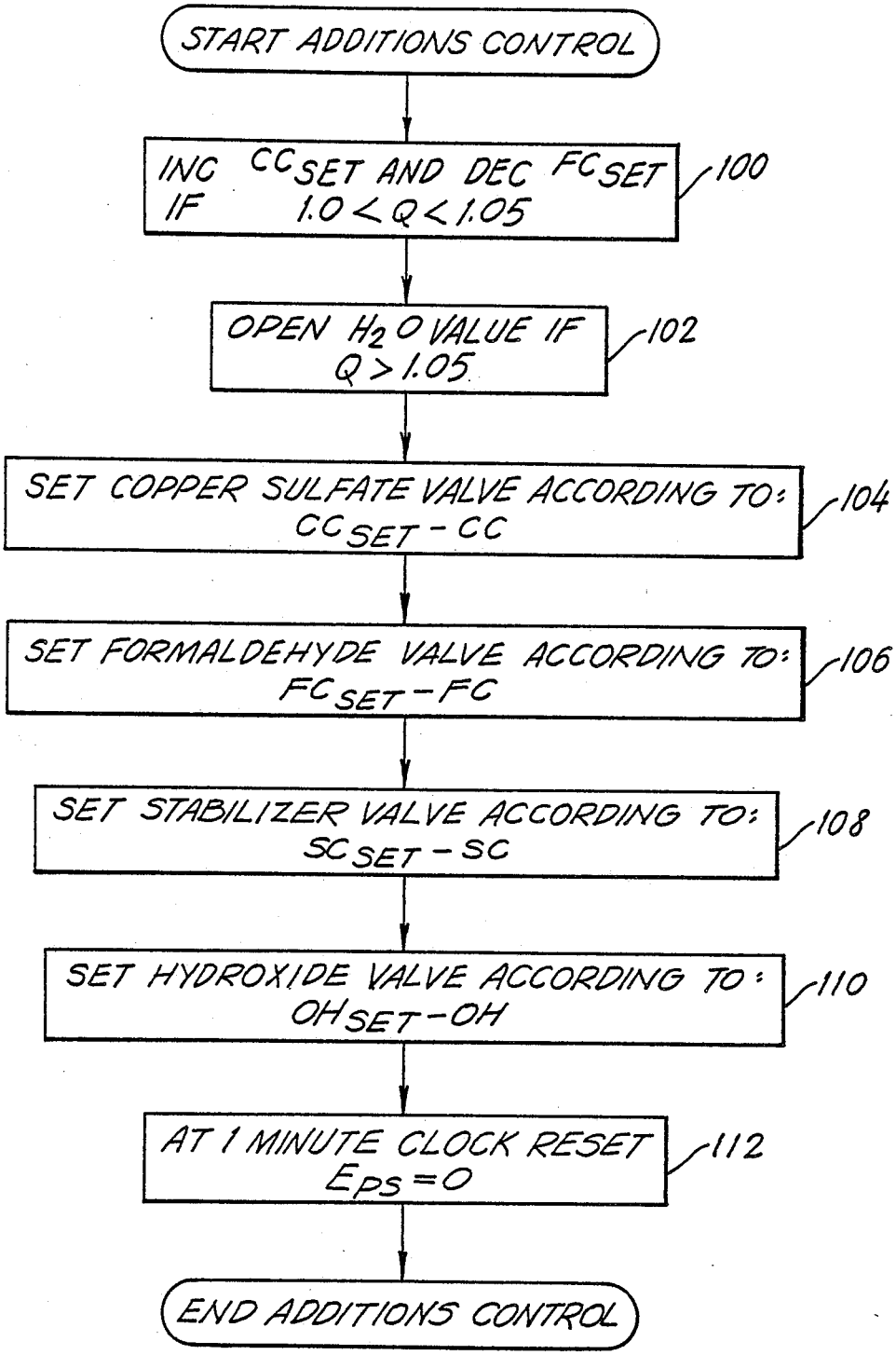

The flow diagram for the additions control sub-routine is shown in FIG. 3D. The addition control is achieved by comparing the various measured concentrations and quality indexes with corresponding set points. The valves 40–44 then are controlled to add chemicals to the bath in accordance with the departures from the set points.

In step 100, the program first analyzes the copper quality index Q to determine if Q is in the range from 1.0 and 1.05. This is the range where mild bath adjustment is indicated which can normally be achieved by adjusting the set points for copper and formaldehyde. In step 100, if Q is in the range of 1.0–1.05, the copper concentration set point $CC_{set}$ is incremented or increased and the formaldehyde concentration set point $FC_{set}$ is decremented or decreased. It also may be desirable to keep track of the number of such adjustments since if the quality index Q does not drop below 1.0 after three iterations, more drastic corrective action may be required.

In step 102, the program determines if the copper quality index Q exceeds 1.05. If so, the system opens valve 44 to add water to the bath. The water addition diltes the bath which then is replenished by the addition of new chemicals as the system re-establishes the concentration set point values.

In step 104 the copper concentration CC is compared to the copper concentration set point $CC_{set}$ and valve 40 is opened for a time period corresponding to the degree of departure from the set point. In step 106 the formaldehyde concentration FC is compared with the formaldehyde concentration set point $FC_{set}$ and valve 41 is opened for a period of time corresponding to the departure from the set point value. In step 108 the stabilizer concentration SC as compared to the stabilizer concentration set point $SC_{set}$ and valve 42 is opened for a period of time corresponding to the departure from the set point. Likewise, in step 110, the hydroxyl concentration OH is comPared to the hydroxyl set point $OH_{set}$ to control the opened interval for valve 43. Thus, additions of the basic chemicals to the bath are controlled in steps 104–110 in accordance with the departure of the actual concentrations from their respective set points.

After completion of the valve settings, the computer in step 112 awaits the clock reset in step 56 to set the power supply voltage to zero to thereby terminate the stripping pulse. The test electrode 11 is thereafter resurfaced during the five second interval provided by time delay 60.

Although a specific computer program has been described according to the invention, there are numerous modifications that may be made without departing from the scope of this invention. The measurement cycle may be modified as previously mentioned. The parameters measured and controlled may vary according to the composition of the bath, e.g., the ions of the metal being plated and the reducing agent employed. The various analysis and control steps may be intermixed with the data acquisition steps. The technique used to adjust the bath to maintain plating quality may vary in accordance with available solution purification apparatus. The invention is more particularly defined in the appended claims.

We claim:

1. A method for analyzing a solution used for electrolessly depositing metal, the solution comprising metallic ions and a reducing agent for said metallic ions, said method comprising:

(a) providing at least two electrodes in the plating solution;

(b) performing an electrochemical analysis of at least one constituent of the plating solution using said electrodes; and (c) providing a reproducible surface on at least one of said electrodes after said analysis to prepare for the next analysis cycle by firstly applying a stripping pulse to the electrode, said pulse capable of removing all the deposited metal and other reaction products from the electrode and secondly resurfacing hte electrode with a clean metal deposit by permitting the electrode to replate in the electroless plating solution.

2. The method according to claim 1 used to control the plating solution wherein the addition of one or more constituents is controlled according to said electrochemical analysis.

3. The method according to claim 1 wherein the metallic ions of the plating solution are copper and the reducing agent is formaldehyde and said analysis determines the formaldehyde concentration.

4. The method according to claim 1 wherein the metallic ions of the plating solution are nickel and the reducing agent is a hypophosphite.

5. The method according to claim 1 wherein the metallic ions of the plating solution are copper and the reducing agent is selected from the group consisting of formaldehyde compounds and boron hydrides.

6. A method for analyzing a solution used for electrolessly depositing metal, the solution comprising metallic ions and a reducing agent for said metallic ions, said method comprising:

(a) placing at least two electrodes in the solution;

(b) applying a sweep potential to said electrodes;

(c) monitoring current flow through said electrodes to determine the peak current flow caused by said applied sweep potential;

(d) calculating concentration of the reducing agent as a function of said peak current; and (e) providing a reproducible surface on at least one of said electrodes before applying a subsequent sweep potential by firstly applying a stripping pulse to the electrode, said pulse capable of removing all the deposited metal and other reaction products from the electrode and secondly resurfacing the electrode with a clean metal deposit by permitting the electrode to replate in the electroless plating solution.

7. The method according to claim 6 wherein addition of the reducing agent to the bath is controlled in accordance with the departure of said calculated concentration from the desired concentration.

8. The method according to claim 6 wherein the metal ions are copper ions, the reducing agent is formaldehyde, and the calculated formaldehyde concentration is calculated from said peak current.

9. A method for analyzing an electroless plating solution comprising metallic ions and a reducing agent to be oxidized to provide for the reduction of said metallic ions, said method comprising:

placing at least two electrodes in the plating bath;

applying a sweep potential to said electrodes;

monitoring the current flow through said electrodes;

determining the intrinsic cathodic reaction rate and the intrinsic anodic reaction rate from the sweep potential and current flow data, and determining a metal plating quality index as the ratio between the intrinsic anodic and cathodic reaction rates.

10. A method according to claim 9 wherein said metallic ions are copper ions, said reducing agent is formaldehyde and said ratio between said anodic and cathodic reaction rates indicate the copper plating quality.

11. A method according to claim 10 wherein composition of the plating solution is controlled by periodic additions of copper ions and/or formaldehyde according to concentration departures from respective set points, and wherein the set point for the copper concentration is increased as said ratio approaches 1.1.

12. A method according to claim 9 wherein at least one of said electrodes is provided with a reproducible surface between successive applications of sweep potentials by electrochemically stripping metal and other reaction products from the electrode, said metal having been formed by metallic ions reduced from the solution, and resurfacing the electrode with a clean metal deposit by permitting the electrode to replate in the plating solution.

13. A method for analyzing an electroless plating solution comprising metallic ions and a reducing agent for said metallic ions, said method comprising:

providing at least two electrodes in the plating solution, one being a test electrode and the other being a counter electrode, the test and counter electrodes having a surface layer composed of the metal of said metallic ions;

carrying out an electrochemical reaction on the surface of said test electrode with said metallic ions or said reducing agent by applying a potential across said electrodes;

measuring the electrochemical reactions; and providing a reproducible surface on said test electrode by electrochemically stripping said surface layer from the test electrode and resurfacing said test electrode with a fresh surface layer comprised of the metal of said metallic ions to prepare for the next cycle by permitting the electrode to replate in the electroless plating solution.

14. The method according to claim 13 in which the measurement of the electrochemical reaction determines the concentration of said metallic ion or said reducing agent.

15. The method according to claim 14 in which the measurement of the electrochemical reaction determines the intrinsic reaction rate of said metallic ion or reducing agent.

16. A method for controlling an electroless copper plating solution comprising copPer sulfate, formaldehyde, a hydroxide and a stabilizer, said method comprising:

placing a counter electrode, a test electrode and a reference electrode in the plating solution;

monitoring the solution potential between said reference electrode and said test electrode;

monitoring current flow through said test and counter electrodes;

applying a sweep potential to said test and counter electrodes; determining the peak current during application of said sweep potential and calculating the formaldehyde concentration as a function of said peak current; and controlling addition of formaldehyde to the solution in accordance with the departure of said calculated formaldehyde concentration from the desired formaldehyde concentration.

17. A method according to claim 16 wherein sensors for measuring temperature and pH are also placed in said solution and wherein said temperature and pH are included in said formaldehyde concentration calculation.

18. A method according to claim 16 wherein the stabilizer concentration of the solution is determined as a function of the bath potential at said peak current.

19. A method according to claim 18 further including controlling the addition of stabilizer to the solution in accordance with the departure of said stabilizer concentration from the desired concentration.

20. A method according to claim 16 wherein a potential is applied to said counter and test electrodes after said sweep potential to deplate at least one of electrodes prior to a new measurement cycle and wherein said deplated electrode is plated with fresh copper from the solution prior to application of a subsequent sweep potential.

21. A method according to claim 16 further including a sensor for measuring the copper concentration in the solution and wherein copper addition to the solution is controlled in accordance with departure of said copper concentration from the desired value.

22. A method according to claim 21 further including determination of copper plating quality index and adjusting the set points for desired copper and formaldehyde concentrations in accordance with the copper plating quality index.

* * * * *

UNITED STATES PATENT AND TRADEMARK OFFICE

CERTIFICATE OF CORRECTION

PATENT NO. : 4,814,197
DATED : March 21, 1989
INVENTOR(S) : John Duffy et al.

It is certified that error appears in the above-identified patent and that said Letters Patent is hereby corrected as shown below:

In Column 1, line 57, "becaus" should read -- because --.

In Column 3, line 46, "contrller" should read -- controller --.

In Column 12, line 27, "steP" should read -- step --.

In Column 14, line 36, "comPared" should read -- compared --.

In Column 15, claim 1(c), line 10, "hte" should read -- the --.

In Column 16, claim 11, line 10, after "increased" insert -- and/or the set point for the formaldehyde concentration is decreased --.

In Column 16, claim 16, line 49, "copPer" should read -- copper --.

Signed and Sealed this

Thirty-first Day of July, 1990

*Attest:*

*Attesting Officer*

HARRY F. MANBECK, JR.

*Commissioner of Patents and Trademarks*